United States Patent [19]

T pholm

[11] Patent Number: 4,947,432

[45] Date of Patent: Aug. 7, 1990

[54] PROGRAMMABLE HEARING AID

[75] Inventor: Jan T pholm, Holte, Denmark

[73] Assignee: Tøpholm & Westermann ApS, Vaerloese, Denmark

[21] Appl. No.: 5,976

[22] Filed: Jan. 22, 1987

[30] Foreign Application Priority Data

Feb. 3, 1986 [DE] Fed. Rep. of Germany ..... 3603204
Dec. 16, 1986 [DE] Fed. Rep. of Germany ..... 3642828

[51] Int. Cl.[5] ..... H04R 25/00
[52] U.S. Cl. ..... 381/68.2; 381/68.4
[58] Field of Search ..... 381/68, 68.2, 68.4, 381/105, 25; 455/91; 340/407

[56] References Cited

U.S. PATENT DOCUMENTS

| | | | |
|---|---|---|---|
| 4,025,721 | 5/1977 | Graupe . | |
| 4,063,410 | 12/1977 | Welling | 455/91 |
| 4,185,168 | 1/1980 | Graupe . | |
| 4,187,413 | 2/1980 | Moser . | |
| 4,188,667 | 2/1980 | Graupe et al. | 381/68.4 |
| 4,228,402 | 10/1980 | Plummer | 381/105 |
| 4,297,677 | 10/1981 | Lewis et al. | 340/407 |
| 4,396,806 | 8/1983 | Anderson . | |
| 4,425,481 | 1/1984 | Mansgold et al. | 381/68 |
| 4,633,498 | 12/1986 | Warnke et al. | 381/25 |
| 4,790,019 | 12/1988 | Hueber | 381/105 |
| 4,845,755 | 7/1989 | Busch et al. | 381/68.4 |

FOREIGN PATENT DOCUMENTS

| | | | |
|---|---|---|---|
| 0064042 | 11/1982 | European Pat. Off. . | |
| 0082905 | 7/1983 | European Pat. Off. | 381/77 X |
| 0168895 | 7/1985 | European Pat. Off. . | |
| 0176116 | 4/1986 | European Pat. Off. . | |
| 1938381 | 2/1971 | Fed. Rep. of Germany . | |
| 3027953 | 2/1982 | Fed. Rep. of Germany . | |
| 3431584 | 3/1986 | Fed. Rep. of Germany | 381/68 |
| DE 3527112A1 | 1/1987 | Fed. Rep. of Germany . | |
| 8001632 | 8/1980 | PCT Int'l Appl. . | |
| 2091065 | 7/1962 | United Kingdom . | |
| 2006559 | 5/1979 | United Kingdom . | |
| 2016767 | 9/1979 | United Kingdom . | |

OTHER PUBLICATIONS

"Programmable Hearing Aid with Multichannel Compression", S. Mangold et al, Scand Audiol 8:121–126, 1979.

"Study of Multichannel Amplitude . . . Hearing Loss", pp. 524–534; R. P. Lippman et al, J. Acoust. Soc. Am. 69(2), Feb. 1981.

*Primary Examiner*—Forester W. Isen
*Attorney, Agent, or Firm*—Sughrue, Mion, Zinn, Macpeak & Seas

[57] ABSTRACT

The invention relates to a programmable hearing aid with an amplifier and transmission section whose transmission characteristics can be controlled, with a control unit (1), with a transmitter for wireless transmission of control signals to the hearing aid (6) and a receiver (7) located therein for receiving and demodulating control signals, whereby the external control unit (1) contains an initial memory (20) for some of the parameters which determine the transmission characteristics of the hearing aid, a control panel with entry keypad (5) for recalling such parameters from the memory, a transmitter (4) which can be modulated with these parameters as control signals and a digital control unit (3) and whereby the hearing aid contains a further control unit (8) which can be activated by the control signals after they have been demodulated, for control of the transmission section.

15 Claims, 3 Drawing Sheets

PROGRAMMABLE HEARING AID

BACKGROUND OF THE INVENTION

The invention relates to a programmable hearing aid with an amplifier section and a transmission section whose transmission characteristics can be controlled. This is the state of the art.

Thus, for instance, from U.S. Pat. No. 4,187,413, corresponding to DE-OS No. 27 16 336, we are familiar with a hearing aid (HDO unit) on which the analog sound signal routed from the microphone, after passing through a low-pass filter, is converted to a digital signal in an analog-to-digital converter and routed to a discrete signal processing circuit whose transmission function of the nth order can be controlled on the basis of parameters stored in an erasable, programmable read-only memory (EPROM) by means of a microprocessor with an arithmetic unit, for matching to the auditory damage. The programming can be changed only by erasing the contents of the EPROM and reprogramming it. The digital signal, thus modified, is then converted back to a corresponding analog signal in a digital-to-analog converter, amplified and routed to the earphone. This unit can be matched only to an individual, pre-determined and quite specific auditory damage level at any one time, determined beforehand with an audiometer. In addition, from EU No. 0064 042 A 1, we are familiar with a circuit arrangement, preferably for a hearing aid, in which the parameters for 8 different ambient situations, for instance, are stored in a memory. The first group of parameters is recalled, for instance, by operating a switch and controls a signal processor connected between the microphone and earphone via a control unit, and the signal processor then sets the first transmission function determined for a scheduled ambient noise situation. All 8 transmission functions can be recalled consecutively via a switch until the correct transmission function is found. On the other hand, an automatic matching facility is provided if the user, for instance, leaves a noisy environment and enters a quiet environment or vice versa.

If one wishes to set other transmission functions, the contents of the non-volatile memory must be erased and the memory must then be reprogrammed with an external programming unit. In this case also, it is possible to match the unit to a changing auditory damage level only with great difficulty.

Further, more detailed tests aimed at providing an improved transmission quality for hearing aids by using a specially developed voice processor with voice compression and separation of voiced and unvoiced sounds are described for instance in IEEE Transactions on Acoustics, Speech and Signal Processing, December 1976, Pages 473 to 480 in the paper by S. G. Knorr "A Hearing Aid for Subjects with extreme High-Frequency Losses".

One further test aimed at improved matching of hearing aids is described in a paper by A. Rihs and D. Wessell "Active Filtering - a step towards the programmable hearing aid" in "Hearing Instruments" Volume 33, No. 10, 1982, Pages 20 and 56.

With the filter arrangement described in the above paper, with a filter stage connected between the microphone plus pre-amplifier and output stage with earphone, utilizing the principle of feedback with phase rotation, the filter stage, in the feedback path between output and input, uses a filter network which is controlled by a programming switch which, in turn, controls groups of various circuits. Each setting of the programming switch can be locked in position (detent) and calibrated to a close tolerance. This also permits matching to the auditory damage level of the patient which is admittedly better but, which can be carried only once.

A further filter system for hearing aids is discussed in detail in US Pat. No. 4,188,667. With this filter system, the pass-band characteristic can be matched to an arbitrarily selected spectrum. In one embodiment, the filter system is located outside the hearing aid and is connected to it by two high-frequency transmission channels, each with transmitter and receiver. The external filter system can also be connected via wires instead of the wireless connection.

All these known arrangements are designed either only for a single transmission function or for a predetermined number and type of transmission functions, and some of them are still equipped with extremely expensive and complex filter systems and, in certain cases, also require relatively large read-only memories whose contents can be erased and reprogrammed.

SUMMARY OF THE INVENTION

The object of the invention is to create a programmable hearing aid which will be truly universal and yet which can be matched individually and whose transmission characteristics can be matched easily to all requirements of the user in situ under an extremely wide variety of ambient situations, by simulation by the hearing aid acoustician.

In accordance with the invention, this is achieved for a programmable hearing aid by assigning the hearing aid an external control unit with a modulatable transmitter for transmission of specific data, determining the transmission characteristics, by means of wireless transmission to the hearing aid and by the hearing aid containing a receiver for receiving and demodulating the signals transmitted without wires and a digital control logic for controlling the transmission section.

Please refer to the other claims for further embodiments of the invention.

BRIEF DESCRIPTION OF THE DRAWINGS

The invention will now be explained in further detail on the basis of one embodiment, in conjunction with the enclosed figures, in which.

DETAILED DESCRIPTION OF THE INVENTION

Figure 1:
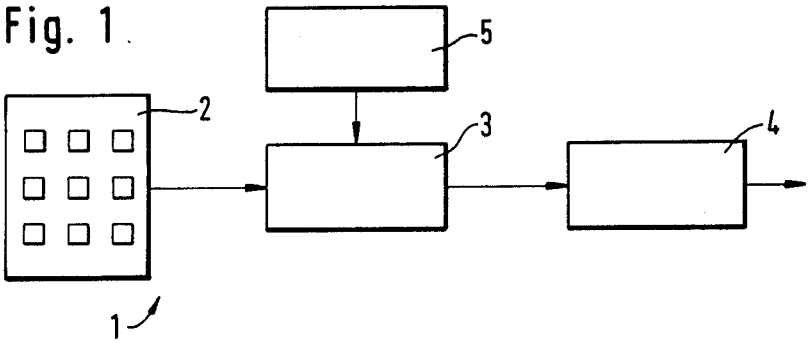
FIG. 1 a schematic diagram of the external control unit.

The external control unit 1, shown schematically in FIG. 1, comprises an entry keypad 2, a digital control unit 3, capable of controlling a modulatable transmitter 4, and a programming device 5, with the aid of which the digital control unit 3 can be programmed.

Figure 2:
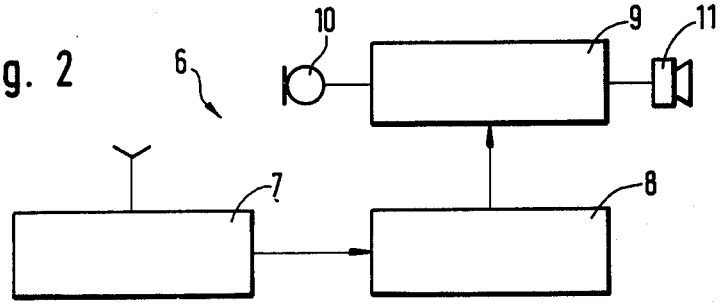
FIG. 2 a schematic diagram of the important parts of the hearing aid.

The hearing aid 6, shown in FIG. 2, contains a receiver 7 with demodulator, a digital control unit 8 which can be controlled by this demodulator and an audio processor 9 which can be controlled by this control unit and which acts as a transmission unit connected between a microphone 10 and an earphone 11. Of course, several microphones with mutually complementary frequency responses and a telephone coil may be provided in place of the one microphone. Likewise, several earphones with mutually complementary frequency responses may be used in place of only one earphone.

Figure 3:
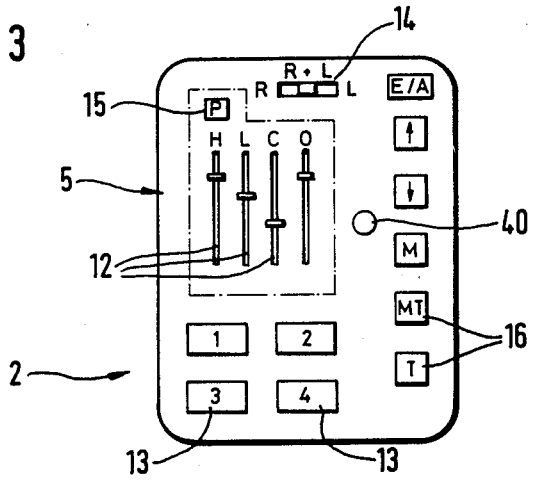
FIG. 3 a front view of the external control unit.

FIG. 3 shows the entry keypad 2 in detail. One can see, drawn purely schematically, a number of adjusting slides 12 which may serve to operate the adjusting trimmers for instance. The drawing shows 4 adjusting slides, designated H, L, C and 0 for higher frequencies, lower frequencies, compression and output power. These adjustment slides are normally covered and not accessible to the user.

One can also see 4 program keys 13 with which the user can select one of 4 previously stored programs. A slide switch 14 is also provided and this can be used to switch over between programming for a hearing aid to be worn in the right ear and a hearing aid to be worn in the left ear. This slide switch 14 also has a center position with which both hearing aids, each with their individual and normally different programmed transmission characteristics can be activated should each ear be provided with a hearing aid.

A program input switch 15 and a row of pushbuttons 16 is provided. The volume for the hearing aid can be increased or reduced with the 2 pushbuttons, each provided either with an arrow pointing upwards or an arrow pointing downwards. The pushbuttons M, MT and T serve to connect the microphone, the microphone and the telephone coil or the telephone coil alone respectively.

Finally, one can see an off/on switch marked E/A for on/off.

After the external control unit has been switched on, the selector switch is set for the left or right hearing aid or for both hearing aids for programming to be carried out by a hearing acoustician. The slide switches are then set to the required position. One of the 4 program positions 13 is then selected for this setting, whereupon the program entry button 15 is pressed. This causes the setting to be stored, as described in greater detail below.

The program buttons 13 shown for program selection are not restricted to the number of buttons shown here, i.e. 4. It goes without saying that far more selectable programs can be assigned to a corresponding number of program buttons.

Figure 4:
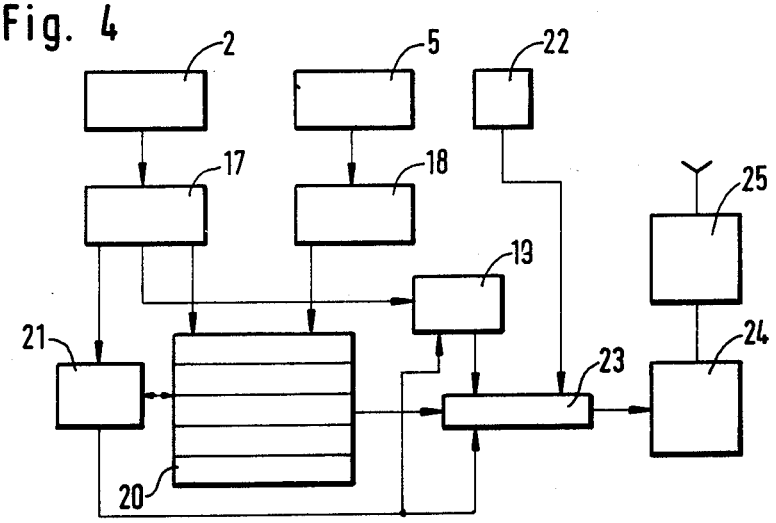
FIG. 4 a block diagram of the external control unit.

FIG. 4 shows a block diagram of the external control unit 2. In turn, one can see a schematic representation of the entry keypad 2 and the programming device 5 which is not accessible to the user. A keypad decoder 17 is connected to the entry keypad 2 whilst a decoder 18 is connected to the programming device 5 and this decoder decodes the setting of the adjusting slides 12. Both decoders are connected to a program memory 20 which preferably incorporates C-MOS circuitry. The values which can be set on the programming device 5 may be either digital or analog values and must be converted accordingly for input to the program memory 20.

The keypad decoder 17 is also connected to a volatile memory 19 for storing the setting of the buttons 16.

Furthermore, a control logic 21 is connected to the keypad decoder 17. This control logic, on the one hand, controls the program memory 20 and, on the other hand, controls the volatile memory 19 and a data register 23 which can be activated by an identity switch 22. This data register is also connected to the outputs of the program memory 20 and the volatile memory 19.

A modulator 24 and a high-frequency oscillator with transmitter 25 are connected to the output of the data register 23.

The identity switch 22 serves to identify the actual user of the hearing aid so that only the hearing aid(s) worn by the user himself or herself can be set to one of the pre-stored programs for transmission characteristics by his or her external control unit. This prevents a user setting someone else's hearing aid to his or her own selected programs and also prevents the user's hearing aid from being set by someone else with the same type of programmable hearing aid to a program not suitable for him or her.

Figure 5:
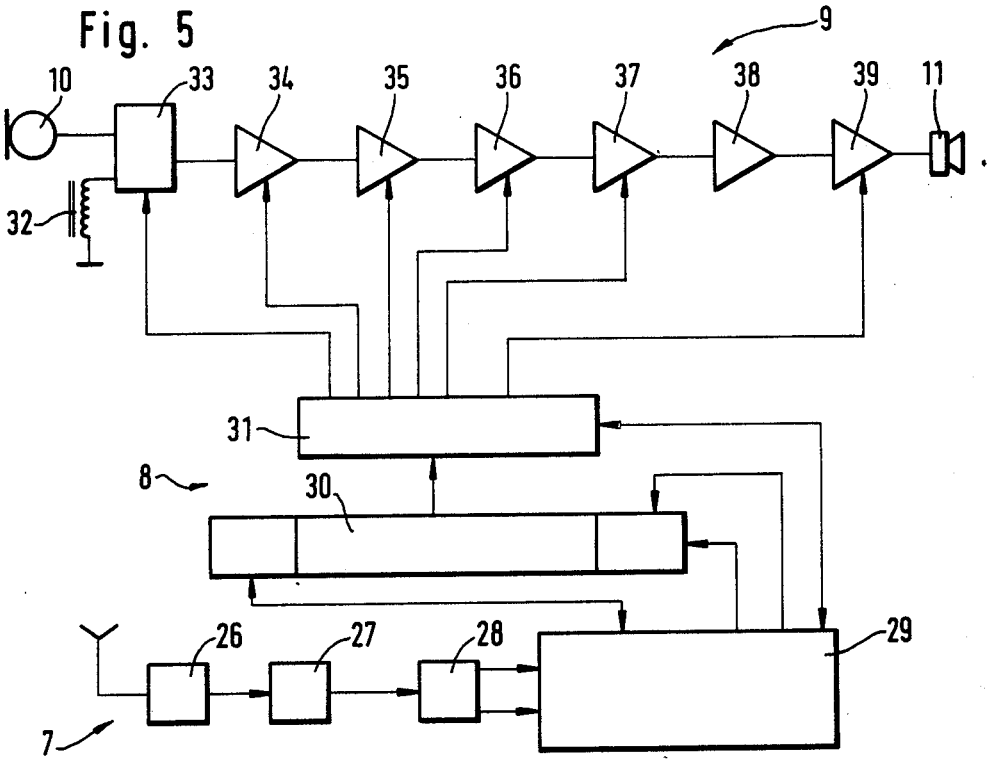
FIG. 5 a block diagram of the related hearing aid.

Finally, FIG. 5 shows the hearing aid 7 with digital control unit 8, audio processor 9, microphone 10 and earphone 11. In particular, the system incorporates a receiver 26 to which a demodulator 27 is connected and the output circuit of this demodulator is connected to a decoder 28 for separating the data and the clock pulses. The two corresponding output leads of the decoder 28 are connected to a control logic 29 which, in turn, controls a serial-to-parallel converter 30 and a program memory 31. This program memory may comprise a number of interlocking circuits for instance.

The data for the parameters determining the transmission characteristics read out serially from the control logic 29 are transferred from the converter 30 in parallel to the program memory 31 and remain stored in this memory for as long as the hearing aid is operating and for as long as an incorporated buffer battery supplies adequate voltage.

The various stages of the audio processor 9 are connected to the outputs of the program memory 31. The microphone 10 and a telephone coil 32 are connected to a mixer stage 33. Connection of the microphone 10 and/or the telephone coil is controlled by buttons M, T or M/T. This mixer stage 33 is followed by an amplifier with high-pass characteristics 34, an amplifier 35 with low-pass characteristics, an amplifier 36 for volume control and an amplifier 37 for automatic gain control, an output amplifier 38 and a limiting amplifier 39.

In addition, FIG. 3 shows a speaking orifice 40 for a further microphone which is a very special aspect of the system. This microphone serves to detect the momentary noise level in the environment of the hearing aid wearer. This may be the quiet conditions of a library, the babble of voices of many people in a heated discussion or the noise of a moving train etc.

A detector amplifier connected in series with the microphone determines this ambient or background noise level, compares it with the stored noise level patterns and, via a control circuit, automatically selects one of the stored groups of parameters which most closely approximate the determined noise level pattern. It thus controls transmission of the signals corresponding to the parameters to the actual hearing aid.

This means that the sound volume range, the compression, the output sound pressure and the overall transmission characteristic in particular of the actual hearing aid can be matched to the relevant ambient conditions.

And now a few remarks on the mode of operation of the actual hearing aid:

As previously mentioned, the hearing aid contains the receiver demodulator 7, the digital control unit 8 and the audio processor 9. The digital control unit operates as follows: it decodes the data accepted in serial form from the external control unit and checks whether the accepted data are valid for the hearing aid in question, i.e. it checks the ID code. It stores the accepted data in the memory, 30, 31. These data are then used for controlling the audio processor with its various stages.

The audio processor then performs all normal functions of a hearing aid, controlled by the digital output signals of the digital control unit. This control function comprises pre-defined amplification, maximum output power, automatic gain control range, lowest frequency which is still to be transmitted, maximum frequency which is still to be transmitted, volume control and similar functions.

This new programmable hearing aid permits an extremely variable setting for various program contents. Transmission from the external control to the hearing aid, termed wireless transmission, can be carried out for instance by ultrasonic signals, infrared radiation or, preferably with electromagnetic waves. When selecting the frequencies, long-wave carrier frequencies will be selected wherever possible, thus permitting the use of ferrite antennas. In addition, this ferrite antenna can also be used as a telephone coil.

On the hearing aid described to date, there is, for the time being, an external control unit in the form of a small box. However, such an auxiliary unit which obviously shows that the user has a hearing impediment is one of the reasons why many users of modern hearing aids prefer not to use a modern high-performance hearing aid. This inhibition must be overcome. As shown in the embodiment in FIG. 6, the external control unit has the form of a wristwatch with a keypad, operating buttons and a device for emitting wireless energy.

Figure 6:
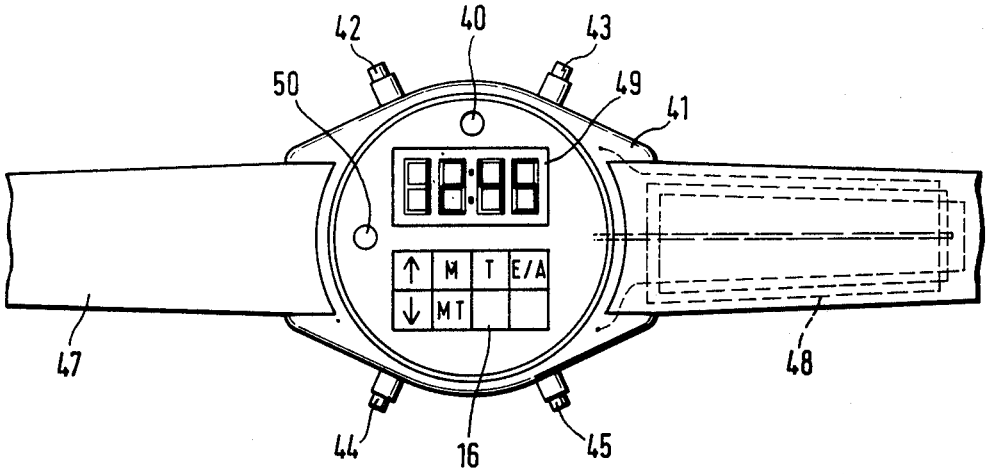
FIG. 6 a further embodiment of an external control unit.

In FIG. 6, one can see a housing 41 which looks like a wristwatch with digital display. On the front side of the housing, one can firstly see a keypad 16 which may be assigned various functions. The two pushbuttons, one with an arrow pointing upwards and one with an arrow pointing downwards, can be used to adjust the volume for the hearing aid.

Buttons M, MT and T serve to connect the microphone, the microphone and telephone coil or the telephone coil alone respectively. The button marked E/A serves as an on/off switch. A speaking orifice, marked 40, is provided for the microphone which serves to control selection of the parameters as a function of the ambient noise.

The four control buttons 42, 43, 44 and 45 can be used to select the program. These buttons may be designed either as detent buttons or non-detent buttons. They could also be configured as double buttons so that a further function can be selected when the outer, thin section is pressed.

In the case of detent-type operating buttons, the function could be triggered either by pressing again or by pressing another operating button. Finally, these buttons could be designed as rotary knobs or as combined pushbuttons and rotary knobs.

One can also see an armband 47 which contains a wire loop 48, coupled to the output of the transmitter, and which serves as an antenna for instance.

On the other hand, a ferrite antenna could be provided in the housing but, in this case, the housing must not have a magnetic screening effect.

Finally, an ultrasonic emitter could be provided either on or in the housing for wireless transmission with ultrasonic signals.

Finally, there is a digital display 49 which may serve to display the currently set program for the buttons operated etc. by way of example.

On the other hand, a quartz timer may also be provided in the housing. A switchover button 50 is provided for this purpose. This button can be used to switch over the display to digital time and/or date display.

Finally, it must also be mentioned that the pushbuttons on the keypad 16 may also be assigned programs for the various transmission characteristics of the hearing aid, which, in the embodiment in question, are assigned to the operating buttons. The functions assigned to the pushbuttons could then be assigned just as well to the operating buttons.

The housing itself does not have to be round. It may also be rectangular, square, hexagonal or octagonal.

The essential advantages of this new hearing aid are as follows:

1. The user may select between various possible settings for the actual hearing aid, for example a setting for quiet rooms, a setting for driving in a car and another setting for listening to music etc.
2. The hearing aid can be operated inconspicously by pressing a corresponding button whilst the external control unit is accommodated in a jacket pocket or a handbag.
3. The control unit can also be used by persons who would normally have difficulties operating extremely small operating elements such as those frequently encountered on modern hearing aids since the keypad has relatively large and easy-to-operate buttons.
4. The external control unit for the hearing aid permits the hearing aid to be matched very elegantly and effectively to the hearing impediment of the user. The hearing aid acoustician can select the settings for the various ambient influences to the full satisfaction of the user by adjusting the unit interactively together with the user.
5. Thanks to the additional microphone in the external control unit, the transmission characteristic of the hearing aid can be controlled completely automatically for matching to the currently dominant ambient noise conditions, in particular in respect of compression, frequency response and output sound pressure etc.

A detector amplifier, connected in series with the microphone and which preferably controls a correspondingly designed microprocessor which then selects the parameter signals to be transmitted to the actual hearing aid and then transmits these signals is used for this purpose.

The following points must also be mentioned:

Ideally, the actual hearing aid has neither controls nor switches but only a battery compartment. The hearing aid is controlled and set by wireless transmission at the control unit. The hearing aid can be used by the user even without the external control unit. However, without the external control unit, it is then not possible to control the hearing aid or switch it on and off.

Alternatively, the actual hearing aid could also be provided with an on/off switch and a volume control for manual operation for cases in which it is impractical for the wearer to have the control unit with him or her (e.g. when swimming).

Overall, this invention represents a modern hearing aid which is capable of meeting a wide variety of requirements in exemplary fashion.

I claim:

1. A remote controlled programmable hearing aid system of the type comprising an amplifier and signal processing section with remotely controllable transfer characteristics, wherein the transfer characteristics at any given time are determined by a group of parameters, said system further comprising user-operable external control unit and a transmitter for wireless transmission of control signals, a hearing aid and a receiver located in said hearing aid for receiving and demodulating said control signals, characterized in that:

said external control unit comprises: a memory (20) for storing a plurality of groups of parameters each for determining a different transfer characteristic of the hearing aid; a control panel with user-operable entry means (2) for randomly accessing and recalling a stored group of parameters from said memory; and a transmitter (4) for transmitting said recalled parameters as control signals; and said hearing aid contains a hearing aid control unit (8) responsive to demodulated control signals from said receiver for controlling the transfer characteristics of said signal processing section.

2. Programmable hearing aid in accordance with claim 1, characterized in that the control unit contains a microphone, a detector circuit connected to it and a control circuit controlled by the detector circuit and that the control circuit automatically controls selection of the parameters stored for such ambient noise for transmission to the hearing aid (6), dependent upon the ambient noise detected by the microphone.

3. Programmable hearing aid in accordance with claim 1, characterized in that a programming device (5), not accessible to the user, is provided in the external control unit (1) for entry of data into said memory.

4. Programmable hearing aid in accordance with claim 1, characterized in that the signal processing section includes a plurality of stages and in that the hearing aid, between said hearing aid control unit and signal processing section, contains a stage (30) for serial-to-parallel conversion and a memory (31) having outputs connected to respective stages of the signal processing section.

5. Programmable hearing aid in accordance with claim 4, characterized in that the signal processing section includes controllable amplifiers (34, 35) with differing pass-band, with volume control (36), with automatic gain control (37), with compression control (38) and with limiting of the maximum output power (39), and that the amplifiers can be controlled by the hearing aid control unit (8), dependent upon the transmitted parameters.

6. Programmable hearing aid in accordance with claim 1, characterized in that the external control unit has the form of a wristwatch (41) with a housing, a microphone, a keypad (16) and operating buttons (42 to 45) and a device (48) for emitting wireless energy.

7. Hearing aid in accordance with claim 6, characterized in that a digital display panel (46) is provided on the external control unit.

8. Hearing aid in accordance with claim 6, characterized in that the housing (41) contains an ultrasonic generator.

9. Hearing aid in accordance with claim 6, characterized in that the housing contains a ferrite antenna.

10. Hearing aid in accordance with claim 6, further including an armband connected to said housing, and characterized in that an antenna (48) is provided in the form of a wire loop in said armband and further characterized in that the wire loop is coupled to the output of the transmitter.

11. Hearing aid in accordance with claim 6, characterized in that the housing contains a digital clock.

12. Hearing aid in accordance with claim 6, characterized in that the operating buttons (41 to 44) are designed as detent-type single pushbuttons.

13. Hearing aid in accordance with claim 6, characterized in that the operating buttons are designed as non-detent single pushbuttons.

14. Hearing aid in accordance with claim 6, characterized in that the operating buttons are designed as double pushbuttons.

15. Hearing aid in accordance with claim 6, characterized in that the operating buttons are designed as rotary knobs.

* * * * *

UNITED STATES PATENT AND TRADEMARK OFFICE

CERTIFICATE OF CORRECTION

PATENT NO. : 4,947,432

DATED : August 7, 1990

INVENTOR(S) : Jan Topholm

It is certified that error appears in the above-identified patent and that said Letters Patent is hereby corrected as shown below:

Title page, left column, [75], delete Inventor's Name "Jan T pholm" and insert --Jan Topholm--.

Signed and Sealed this

Fourteenth Day of January, 1992

*Attest:*

HARRY F. MANBECK, JR.

*Attesting Officer*

*Commissioner of Patents and Trademarks*

US004947432B1

REEXAMINATION CERTIFICATE (1944th)

United States Patent [19]

Tøpholm

[11] B1 4,947,432

[45] Certificate Issued Mar. 9, 1993

[54] PROGRAMMABLE HEARING AID

[75] Inventor: Jan Tøpholm, Holte, Denmark

[73] Assignee: Tøpholm & Westermann Aps, Vaerloese, Denmark

Reexamination Request:
No. 90/002,658, Feb. 13, 1992

Reexamination Certificate for:

| | |
|---|---|
| Patent No.: | **4,947,432** |
| Issued: | **Aug. 7, 1990** |
| Appl. No.: | **5,976** |
| Filed: | **Jan. 22, 1987** |

Certificate of Correction issued Jan. 14, 1992.

[30] Foreign Application Priority Data

Feb. 3, 1986 [DE] Fed. Rep. of Germany ..... 3603204
Dec. 16, 1986 [DE] Fed. Rep. of Germany ..... 3642828

[51] Int. Cl.[5] ..... H04R 25/00

[52] U.S. Cl. ..... 381/68.2; 381/68.4

[58] Field of Search ..... 381/68, 68.2, 68.4

[56] References Cited

U.S. PATENT DOCUMENTS

| | | | |
|---|---|---|---|
| 3,531,595 | 9/1970 | Demaree . | |
| 3,571,529 | 3/1971 | Gharib et al. . | |
| 3,927,279 | 12/1975 | Nakamura et al. . | |
| 3,989,904 | 11/1976 | Rohrer et al. | 381/68.2 |
| 4,063,410 | 12/1977 | Welling . | |
| 4,099,163 | 7/1978 | Worley et al. | 340/825.26 |
| 4,189,713 | 2/1980 | Duffy | 340/168 |
| 4,223,181 | 9/1980 | Simeau . | |
| 4,259,742 | 3/1981 | Burns et al. | 455/52 |
| 4,365,633 | 12/1982 | Loughman et al. | 128/419 PG |
| 4,396,806 | 8/1983 | Anderson | 381/103 |
| 4,425,481 | 1/1984 | Mansgold et al. . | |
| 4,508,940 | 4/1985 | Steeger | 381/68.2 |
| 4,575,586 | 3/1986 | Topholm . | |
| 4,680,798 | 7/1987 | Neumann | 381/68.4 |
| 4,918,736 | 4/1990 | Bordewijk | 381/68 |

FOREIGN PATENT DOCUMENTS

| | | |
|---|---|---|
| 0175909 | 8/1984 | European Pat. Off. . |
| 2321765 | 5/1974 | Fed. Rep. of Germany . |
| 2716336 | 4/1977 | Fed. Rep. of Germany . |
| 2719973 | 12/1977 | Fed. Rep. of Germany . |
| 52-50646 | of 1977 | Japan . |
| 53-75013 | 6/1978 | Japan . |
| 54-92146 | 6/1979 | Japan . |

OTHER PUBLICATIONS

Katz & Wentzel, "A Portable Tactile Aid for the Deaf Using a Z80 Microprocessor Controller", *Proceedings of the New England BOERG Conference*, Mar. 22, 1979, pp. 336–339.

Mangold et al, "Multichannel Compression in a Portable Hearing Aid", Hearing Aid Journal, Apr., 1981, pp. 6, 29–30, 32.

Moser, "Hörgerat mit diskreter Signalverarbeitung" (Hearing Aid with Discrete Signal Processing) Zeitschrift für Hrgerate-Akustik, Band 17, 1978, Heft 4 (Jul.), pp. 124–135.

*Primary Examiner*—Forester W. Isen
*Attorney, Agent, or Firm*—Sughrue, Mion, Zinn, Macpeak & Seas

[57] ABSTRACT

The invention relates to a programmable hearing aid with an amplifier and transmission section whose transmission characteristics can be controlled, with a control unit (1), with a transmitter for wireless transmission of control siganls to the hearing aid (6) and a receiver (7) located therein for receiving and demodulating control signals, whereby the external control unit (1) contains an initial memory (20) for some of the parameters which determine the transmission characteristics of the hearing aid, a control panel with entry keypad (5) for recalling such parameters from the memory, a transmitter (4) which can be modulated with these parameters as control signals and a digital control unit (3) and whereby the hearing aid contains a further control unit (8) which can be activated by the control signals after they have been demodulated, for control of the transmission section.

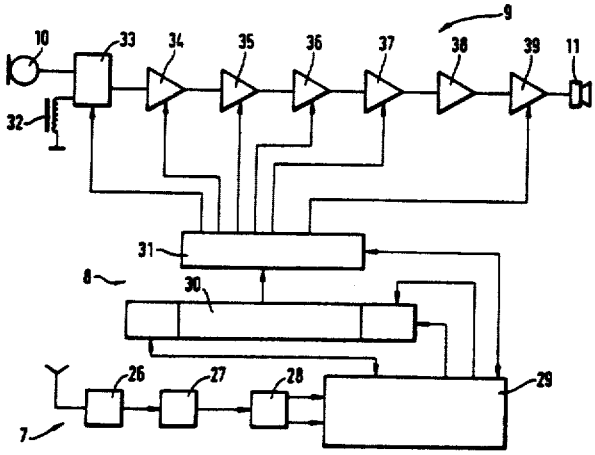

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT THAS BEEN DETERMINED THAT:

The patentability of claims 1–15 is confirmed.

New claims 16–20 are added and determined to be patentable.

*16. A programmable hearing aid in accordance with claim 1, wherein each of said plurality of groups of parameters represents a different fixed transfer characteristic of said hearing aid, and wherein said hearing aid control unit controls the transfer characteristics of said signal processing section by setting the transfer characteristic of the hearing aid to the fixed transfer characteristic represented by said demodulated control signals.*

*17. A programmable hearing aid in accordance with claim 1, wherein said signal processing section includes a plurality of stages operating in accordance with respective parameters, and wherein said hearing aid control unit includes means for coupling said parameters to respective stages of said signal processing section.*

*18. A programmable hearing aid in accordance with claim 1, wherein said entry means comprises a plurality of selection switches each corresponding to a different predetermined one of said plurality of different transfer characteristics.*

*19. A programmable hearing aid in accordance with claim 1, wherein said hearing aid includes a memory storing only a single one of said groups of parameters.*

*20. A programmable hearing aid in accordance with claim 1, wherein said hearing aid does not store plural groups of parameters, whereby changing the parameter group currently determining the transfer characteristics of said hearing aid requires the transmission of a new parameter set from said external control unit.*

* * * * *